US005363955A

United States Patent [19]

Fleenor

[11] Patent Number: 5,363,955

[45] Date of Patent: Nov. 15, 1994

[54] HINGED LID BOX WITH ATTACHED COUPON

[75] Inventor: J. Jerome Fleenor, Midlothian, Va.

[73] Assignee: Philip Morris Incorporated, New York, N.Y.

[21] Appl. No.: 133,946

[22] Filed: Oct. 12, 1993

[51] Int. Cl.[5] ..... B65D 85/10; B65D 43/16

[52] U.S. Cl. ..... 206/273; 206/268; 206/831; 229/160.1

[58] Field of Search ..... 206/254, 264, 268, 273, 206/831; 229/160.1

[56] References Cited

U.S. PATENT DOCUMENTS

| | | | |
|---|---|---|---|
| 223,432 | 1/1880 | Brooks | 206/831 X |
| 348,924 | 9/1886 | Munson . | |
| 476,765 | 6/1892 | Knapp . | |
| 1,116,043 | 11/1914 | Elliott . | |
| 2,445,001 | 7/1948 | Pence . | |
| 2,790,587 | 4/1957 | Contant | 206/831 X |
| 2,944,555 | 7/1960 | Peel et al. . | |
| 4,753,383 | 6/1988 | Focke et al. . | |
| 4,753,384 | 6/1988 | Focke et al. . | |
| 4,948,038 | 8/1990 | Moeller . | |
| 4,949,841 | 8/1990 | Focke et al. . | |
| 5,074,462 | 12/1991 | Countee Jr. . | |
| 5,137,148 | 8/1992 | Evers . | |
| 5,160,024 | 11/1992 | Evers . | |
| 5,236,084 | 8/1993 | Evers . | |

FOREIGN PATENT DOCUMENTS

| | | |
|---|---|---|
| 643514 | 6/1962 | Canada . |
| 86985 | 3/0259 | Denmark . |
| 2323173 | 5/1973 | Germany . |

*Primary Examiner*—Bryon P. Gehman

*Attorney, Agent, or Firm*—Kevin B. Osborne; James E. Schardt; Charles E. B. Glenn

[57] ABSTRACT

A hinged lid cigarette pack includes a bottom portion defining a receptacle for the cigarettes and a hingably connected lid which closes over the cigarette. A tab is foldably connected to the front wall of the lid at a mating edge between the lid front wall and the bottom portion front wall. The tab comprises a front tab panel foldably connected to the lid front wall at the mating edge and a top tab panel foldably connected to the front tab panel via a first tab fold line. A back tab panel is foldably connected to the top panel via a second tab fold line which is located opposite to the first tab fold line. When the lid is closed, the respective tab panels lie in a face-to-face contact with corresponding front, top and back walls of the lid. When the lid is open, the tab does not interfere with access to the cigarettes. At the desired time, the tab is extended such that the panels lie in substantially the same plane to read messages printed thereon. The consumer may then remove the desired number of tab panels by tearing along detachment lines. The front, top and back tab panels may be subdivided into additional tab panel sections which are interconnected via additional attachment lines.

19 Claims, 3 Drawing Sheets

Fig. 1
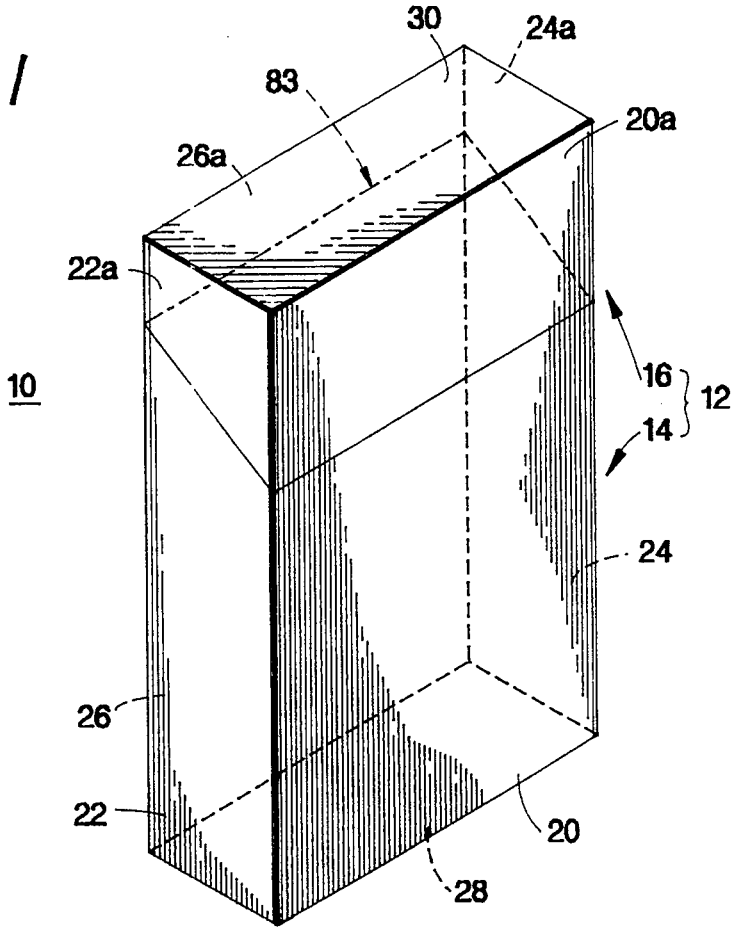
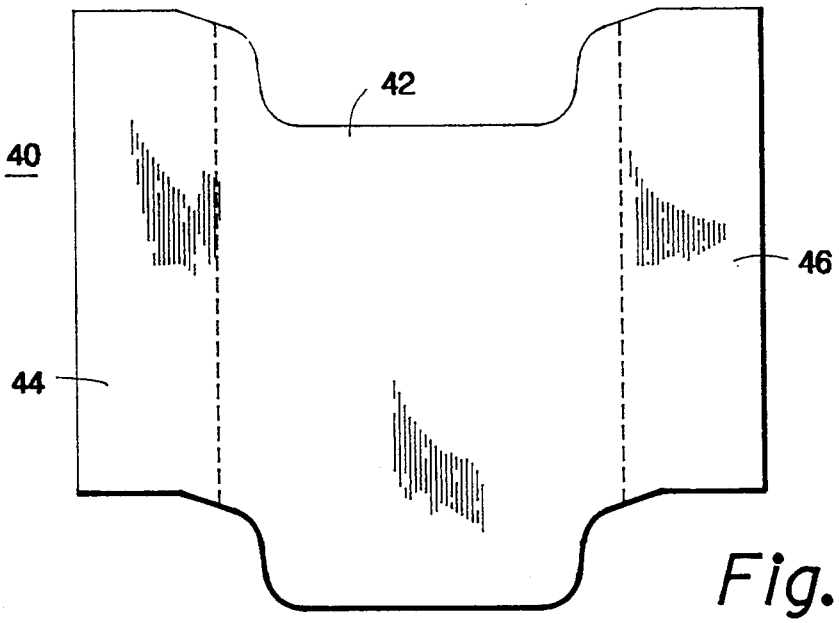
Fig. 2

Fig. 4
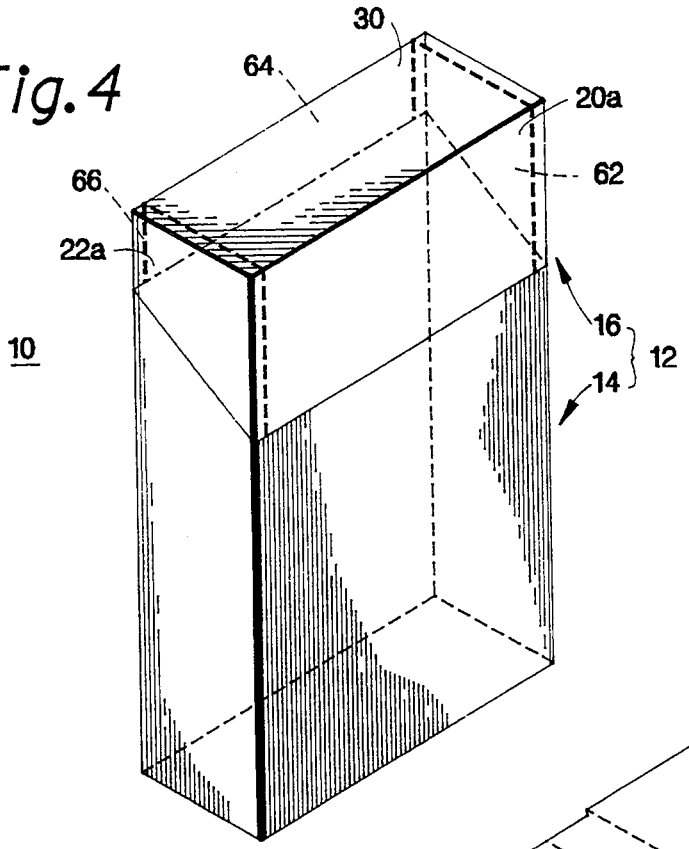
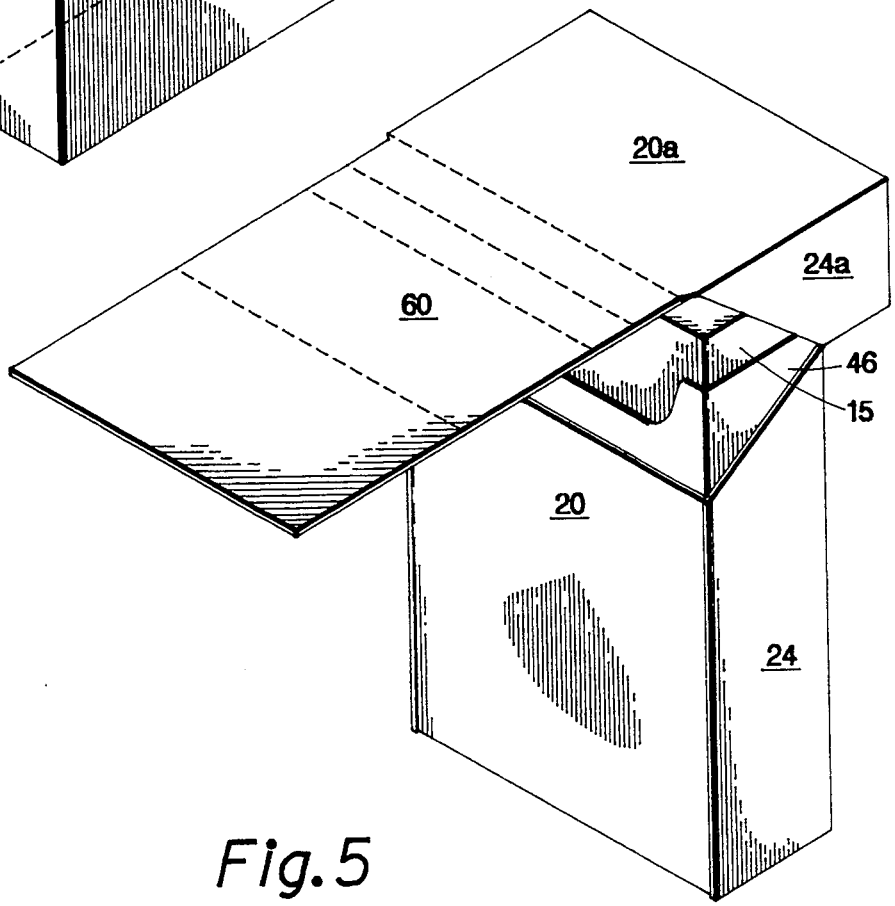
Fig. 5

HINGED LID BOX WITH ATTACHED COUPON

RELATED PATENTS

The present application relates to commonly assigned U.S. Pat. No. 5,236,084, issued Aug. 17, 1993, which is hereby incorporated by reference.

BACKGROUND OF THE INVENTION

1. Technical Field of the Invention

This invention relates to cigarette packs, and more particularly to cigarette packs in the form of boxes having a tab.

2. Discussion of Related Art

Cigarette packs in the form of boxes are extremely well known. One of the most popular forms of such boxes has an outer member which includes a lower portion in which the cigarettes stand vertically. The upper portion is a lid which is often, although not always, hinged to the back of the lower portion so that the upper ends of the cigarettes are exposed when the lid is tipped back to open the box to form the so-called hinged lid box. Such boxes typically have an innerframe inside the outer member which extends up from the lower portion under the lid to provide some interference with the lid as it opens and closes. This interference helps to keep the lid firmly and neatly closed and reduces the risk that the lid will open accidentally.

Cigarette packs of the foregoing type are relatively small and strong. The visible exterior surfaces are needed for brand-identifying information, contents specifications and required warning labels. There is therefore little or no space on the outside of the pack for additional information such as promotional coupons, and even if such additional information could be put on the outside of the pack, it would be difficult for the consumer to remove that information such as a coupon from the pack. Placing coupons or other information separately in the pack is disadvantageous because such placement necessitates additional processing steps, additional production equipment and increased production costs, and the consumer may not notice the information.

The attachment of information bearing tabs has been proposed as a solution to these problems. To be successfully implemented, this proposal needs to be relatively straightforwardly adapted to conventional pack formation techniques to avoid costly and time consuming modifications or new machinery. In addition, the informative tab should not present any obstacle to normal use of the product while still achieving its goal of accessibility and easy removal at a desired time, e.g., at opening or any time thereafter prior to closing the lid.

It is therefore an object of this invention to provide a cigarette pack having additional surface areas which can be used for a coupon or other information.

It is another object of the present invention to provide a removable information area which does not interfere with access to the cigarettes.

It is a further object of this invention to provide a cigarette pack having an additional but removable information area, which pack functions as a standard pack before and after the additional information area is removed.

It is another object of the present invention to provide a removable information area to a pack which is removable whenever the consumer desires after opening the pack.

It is a further object of the present invention to accomplish the foregoing objects with a minimum of machinery modification.

It is another object of the present invention to accomplish the foregoing objects using a minimum of materials.

SUMMARY OF THE INVENTION

The foregoing and additional objects are obtained by a cigarette pack for packaging cigarettes according to the present invention. A lower box is provided comprising bottom, front, back and two side walls which define a receptacle for the cigarettes. A hinged lid box comprising a top, front, back and two side walls is hingably connected at its back wall to the back wall of the lower box such that the hinged lid box is closable over the contained cigarettes and respective front and side walls of the hinged lid box mate with respective front and side walls of the lower box at respective mating edges. A tab, which may be printed with coupon, promotional or other information, is detachably attached to the mating edge of the front wall of the hinged lid box via a detachment line. The tab comprises a tab front panel which is detachably attached to the mating edge of the front wall of the hinged lid box and a top tab panel foldably connected to the front tab panel via a first tab fold line opposite the detachment. The tab is folded within the hinged lid box by folding the front tab panel about the detachment line such that it lies in a face-to-face relationship with the front wall of the hinged lid box, and by folding the top tab panel about the first tab fold line such that it lies in a face-to-face contact with the top panel of the hinged lid box. The tab may further comprise a back tab panel which is foldably connected to the top tab panel via a second tab fold line opposite the first tab fold line. Back tab panel is folded along the second tab fold line such that is lies in a face-to-face contact with the back panel of the hinged lid box. Accordingly, the tab is folded within the hinged lid box over the cigarettes when the hinged lid box is closed. When desired, the tab is removed by opening the hinged lid box and tearing along the detachment line.

BRIEF DESCRIPTION OF THE FIGURES

FIG. 1 is an isometric view of a cigarette pack of an illustrative type with which this invention can be employed;

FIG. 2 is a front view of an illustrative innerframe blank that can be used with this invention;

FIG. 4 shows the erected blank of FIG. 3 with the illustrative innerframe of FIG. 2 and with the hinged lid pivoted to a closed position; and FIG. 5 shows the fully erected blank of FIG. 3 with the hinged lid pivoted back to an open position and the lid tab fully extended from the front wall of the hinged lid.

DETAILED DESCRIPTION OF THE INVENTION

Figure 3:
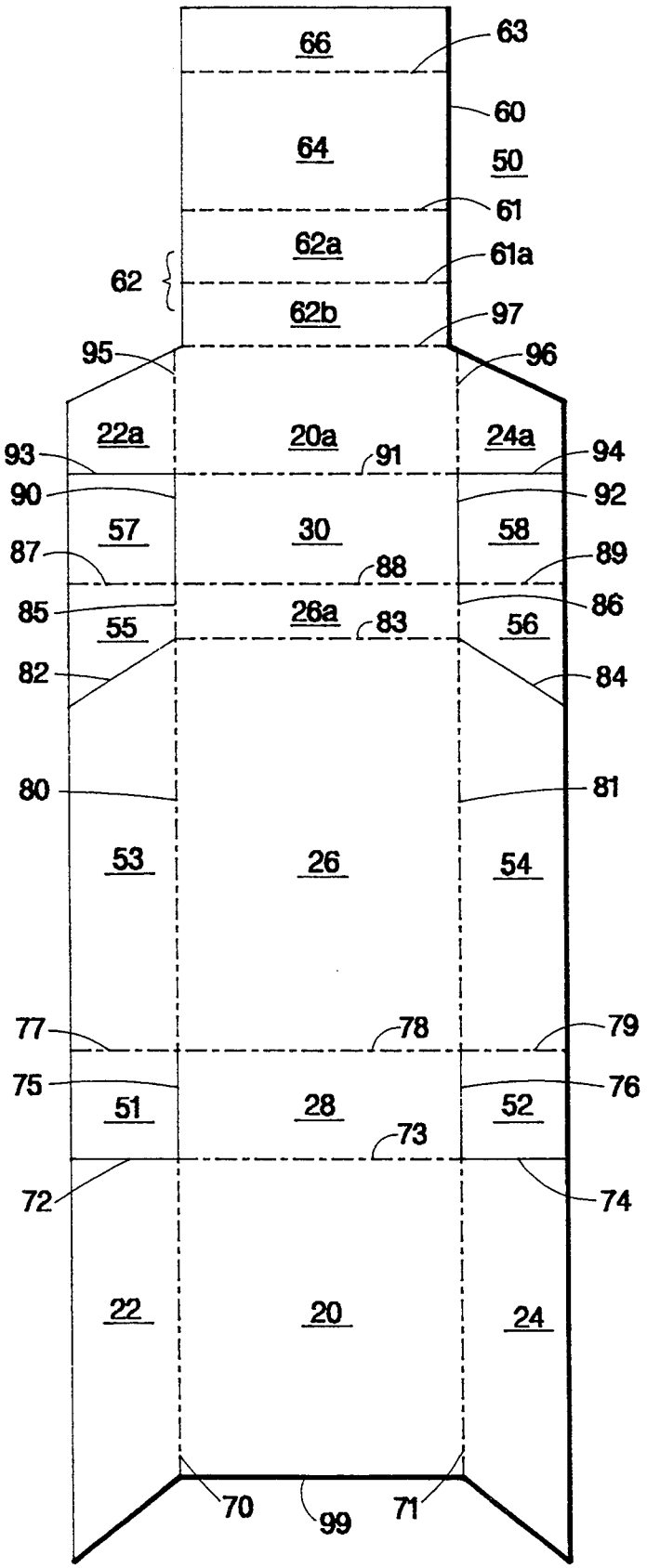
FIG. 3 is a top view of a preferred embodiment of the pack blank according to this invention.

As shown in FIG. 1, a conventional paperboard, hinged lid, box-type cigarette pack 10 includes an outer member 12 having a lower box portion 14 and an upper lid box portion 16. Lower portion 14 has an interconnected front wall 20, a left side wall 22, a right side wall 24, a rear wall 26, and a bottom wall 28. Lid 16 has similar interconnected front **20*a*, left side 22*a***, right side 24*a*, and rear 26*a* walls which respectively function as continuations of the similarly named and referenced lower portion walls when the lid 16 is closed as shown in FIG. 1. In addition, lid 16 has a top wall 30. Lid 16 is typically hingably connected to lower portion 14 along hinge line 83 where respective rear walls 26 and 26*a* meet one another. When lid 16 is tipped back along hinge line 83, the pack has the appearance shown in FIG. 5.

FIG. 2 depicts an innerframe 40 which is conventionally included inside lower portion 14. Innerframe 40 includes a front wall 42, a left side wall 44, and a right side wall 46. The central upper portion of innerframe front wall 42 has a depression or cutout to facilitate consumer access to the upper ends of the cigarettes in the pack. Typically, cigarettes are initially wrapped in foil to form a cigarette bundle 15 inside innerframe 40 as shown in FIG. 5. The upper front portion of this foil wrapper may be removed by the consumer when he or she opens the pack. Innerframe 40 is typically glued to panels 22 and 24 and/or panel 20. Innerframe front wall 42 need not extend to bottom wall 28. When lid 16 is closed, it fits down over and completely covers the portion of innerframe 40 which projects above lower portion 14 as well as cigarette bundle 15. Innerframe 40 interferes somewhat with lid 16 as the lid is opened and closed. This interference helps to keep lid 16 neatly closed and reduces the risk of the pack opening accidentally.

Cigarette pack 10 according to the present invention is preferably erected from paperboard pack blank 50. The preferred embodiment of blank 50 is shown in FIG. 3 prior to erection with the primary printed side down. Similar reference numbers are used in FIG. 3 and subsequent Figures for elements which are similar or related to elements described above. The components will be referred to as panels in the blank configuration and walls in the pack configuration. The adverb "substantially" will be employed to define relationships with desired design tolerances.

Blank 50 includes lower and top or lid front panels 20 and 20*a*, outside left and right panels 22 and 24, lower left and right flaps 51 and 52, bottom and top panels 28 and 30, lower and lid rear panels 26 and 26*a*, inside left and right panels 53 and 54, lid inside left and right panels 55 and 56, lid left and right flaps 57 and 58, lid outside left and right panels 22*a* and 24*a*, and tab 60 integrally formed from conventional materials.

Lower front panel 20 is defined in the longitudinal direction by the separation between substantially parallel lower front score line 73 and lower front panel margin or edge 99. Lower front panel 20 is defined in the lateral direction by first side score line 70 and second side line 71 which connect line 73 and margin 99. Preferably, line 73 is a straight line. Preferably, side score lines 70 and 71 are straight lines, substantially parallel to each other and substantially perpendicular to line 73 and margin 99.

Outside left and right panels 22 and 24 are connected to lower front panel 20 along lines 70 and 71, respectively. Preferably, the longitudinal and lateral dimensions of outside left panel 22 are substantially equal to the corresponding longitudinal and lateral dimensions of outside right panel 24.

Bottom panel 28 extends from lower front panel 20 at line 73 to lower score line 78, and is further defined by first and second cuts 75 and 76. Preferably, line 78 is a straight line, substantially parallel to line 73, and substantially perpendicular to cuts 75 and 76. The longitudinal dimension of bottom panel 28 is substantially equal to the lateral dimensions of outside left and right panels 22 and 24. Preferably, cut 75 is a collinear extension of line 70. Similarly, cut 76 is preferably a collinear extension of line 71.

Lower rear panel 26 extends from bottom panel 28 at line 78 to hinge line 83, and is further defined by third and fourth side score lines 80 and 81. Preferably, line 83 is a straight line, substantially parallel to line 78, and substantially perpendicular to lines 80 and 81. Preferably, line 80 is a collinear extension of cut 75. Similarly, line 81 is preferably a collinear extension of cut 76. Preferably, the longitudinal dimension of bottom rear panel 26 is greater than the longitudinal dimension of lower front panel 20, i.e., the distance between lines 78 and 83 is greater than the distance between margin 99 and line 73.

Inside left and right panels 53 and 54 are connected to lower rear panel 26 along lines 80 and 81, respectively. Inside left panel 53 is defined in the longitudinal direction by left bottom score line 77 and fifth cut 82. Inside right panel 54 is defined in the longitudinal direction by right bottom score line 79 and sixth cut 84. Preferably, the shape and size of inside left panel 53 are substantially equal to the shape and size of outside left panel 22. Similarly, it is preferred that the shape and size of inside right panel 54 are substantially equal to the shape and size of outside right panel 24.

Lower left flap 51 is connected to inside left panel 53 along line 77, and lower right flap 52 is connected to inside right panel 54 along line 79. Lower left flap 51 is defined in the longitudinal direction by third cut 72 and line 77. Lower right flap 52 is defined in the longitudinal direction by fourth cut 74 and line 79. Preferably, the lateral dimensions of lower left and right flaps 51 and 52 are slightly less than the longitudinal dimension of bottom panel 28. Preferably, lines 77 and 79 are offset above line 78 by a distance equal to the thickness of paperboard blank 50. These offsets facilitate folding of the flaps and side panels.

Lid rear panel 26*a* extends from lower rear panel 26 at hinge line 83 to rear score line 88, and is further defined by fifth and sixth side score lines 85 and 86. Preferably, line 88 is a straight line, substantially parallel to hinge line 83, and substantially perpendicular to lines 85 and 86. Preferably, line 85 is a collinear extension of line 80. Similarly, line 86 is preferably a collinear extension of line 81.

Lid inside left and right panels 55 and 56 are connected to lid rear panel 26*a* along lines 85 and 86, respectively. Lid inside left panel 55 is defined in the longitudinal direction by left rear score line 87 and cut 82. Lid inside right panel 56 is defined in the longitudinal direction by right rear score line 89 and cut 84.

Lid top panel 30 extends from lid rear panel 26*a* at line 88 to top score line 91, and is further defined by seventh and eighth cuts 90 and 92. Preferably, line 91 is a straight line, substantially parallel to line 88, and substantially perpendicular to cuts 90 and 92. The longitudinal dimension of lid top panel 30 is preferably substantially equal to the longitudinal dimension of bottom panel 28, i.e., the distance between lines 88 and 91 is substantially equal to the distance between lines 73 and 78. Lid left flap 57 is connected to lid inside left panel 55 along line 87, and lid right flap 58 is connected to lid inside right panel 56 along line 89. Lid left flap 57 is defined in the longitudinal direction by ninth cut 93 and line 87. Lid right flap 58 is defined in the longitudinal direction by tenth cut 94 and line 89. Preferably, the lateral dimensions of lid left and right flaps 57 and 58 are slightly less than the longitudinal dimension of lid top panel 30. Preferably, lines 87 and 89 are offset below line 88 by a distance equal to the thickness of paperboard blank. These offsets facilitate folding of the flaps and side panels.

Lid front panel 20*a* extends from lid top panel 30 at line 91 to tab detachment line 97, and is further defined by seventh and eighth side score lines 95 and 96. Preferably, detachment line 97 is a straight line, substantially parallel to line 91, and substantially perpendicular to lines 95 and 96. Preferably, line 95 is a collinear extension of cut 90. Similarly, line 96 is preferably a collinear extension of cut 92. Preferably, the longitudinal dimension of lid front panel 20*a* is greater than the longitudinal dimension of lid rear panel 26*a*, i.e., the distance between lines 91 and 97 is greater than the distance between lines 83 and 88. Lid outside left and right panels 22*a* and 24*a* are connected to lid top front panel 20*a* along lines 95 and 96, respectively. Preferably, the shape and size of lid outside left panel 22*a* are substantially equal to the shape and size of lid inside left panel 55. Similarly, it is preferred that the shape and size of lid outside right panel 24*a* are substantially equal to the shape and size of lid inside right panel 56.

Tab panel 60 extends from top front panel 20*a* at detachment line 97. Preferably, detachment line 97 is a straight line, substantially parallel to line 91. Preferably, line 97 is formed by perforations and/or partial scoring to facilitate detachment and removal of tab 60 when desired.

More specifically, tab 60 comprises a tab front panel 62, a tab top panel 64 and a tab back panel 66. Tab front panel 62 is removably attached to lid front panel 20*a* via detachment line 97. Tab top panel 64 is foldably connected to tab front panel 62 via a scored fold line 61 which is located opposite to and substantially parallel with detachment line 97. Tab back panel 66 is likewise foldably connected to top tab panel 64 via a scored fold line 63 which is located opposite to and is substantially parallel with fold line 61. Tab front panel 62, tab top panel 64 and tab back panel 66 preferably have a smaller horizontal width, as depicted in FIGS. 3 and 4, than corresponding lid front wall 20*a*, top wall 30 and lid back wall 22*a* of the lid, and have slightly shorter horizontal lengths, i.e., lines 97, 61 and 63 are shorter and are spaced apart slightly less than lines 91 and 88 to permit the tab 60 to folded into the formed lid. The panel widths of tab 60 may be tailored to the specific space required for the desired informational or promotional message. Also, tab 60 can have any desired geometric configuration so long as it is foldable within the lid.

The blank 50 shown in FIG. 3 is erected to form the pack 10 shown in FIG. 1. As shown in FIG. 4, tab 60 is folded along tab detachment line 97 so that tab front panel 62 is substantially parallel with and in face-to-face contact with the inner side of front wall 20*a* of the lid. Tab top panel 64 is folded along fold line 61 such that it is substantially perpendicular to tab front panel 62 and such that it is substantially parallel with and in face-to-face contact with the inner side of top wall 30 of the lid. Similarly, tab back panel 66 is folded along fold line 63 such that it substantially perpendicular to tab top panel 64, such that it is and substantially parallel with oppositely located tab front panel 62 and such that it is substantially parallel with and in face-to-face contact with back wall 26*a* of the lid. Accordingly, message tab 60 is folded within the inner side of lid 16 and surrounds the cigarette bundle 15 located within the pack 10. This folding is straightforwardly accomplished by a slight modification of a standard packaging machine since tab folding only involves basically ninety degree folds simultaneously with the associated lid panels.

Lid left flap 57 and lid inside left panel 55 are erected substantially perpendicular to top panel 30 and top rear panel 26*a* by folding along fifth side score line 85. Similarly, lid right flap 58 and lid inside right panel 56 are erected substantially perpendicular to top panel 30 and lid rear panel 26*a* by folding along sixth side score line 86. Lid left flap 57 is erected substantially perpendicular to lid inside left panel 55 by folding along left rear score line 87. Similarly, lid right flap 58 is erected substantially perpendicular to lid inside right panel 56 by folding along right rear score line 89.

Inside left panel 53 and lower left flap 51 are erected substantially perpendicular to lower rear panel 26 and bottom panel 28 by folding along third side score line 80. Similarly, inside right panel 54 and lower right flap 52 are erected substantially perpendicular to lower rear panel 26 and bottom panel 28 by folding along fourth side score line 81. Lower left flap 51 is erected substantially perpendicular to inside left panel 53 by folding along left lower score line 77. Similarly, lower right flap 52 is erected substantially perpendicular to inside right panel 54 by folding along right lower score line 79.

Lid top panel 30, lid front panel 20*a* , tab 60, and lid outside left and right panels 22*a* and 24*a* are erected substantially perpendicular to lid rear panel 26*a* by folding along rear score line 88.

Bottom panel 28, lower front panel 20, and outside left and right panels 22 and 24 are erected substantially perpendicular to lower rear panel 26 by folding along lower score line 78.

Lid front panel 20*a*, tab connector panel 59, tab 60, and lid outside left and right panels 22*a* and 24*a* are erected substantially perpendicular to lid top panel 30 by folding along lid score line 91.

Lower front panel 20, and outside left and right panels 22 and 24 are erected substantially perpendicular to bottom panel 28, and lower front panel 20 is erected substantially parallel to tab 60, by folding along bottom front score line 73.

Lid outside left panel 22*a* is erected substantially perpendicular to lid front panel 20*a*, and substantially parallel to contiguous lid inside left panel 55, by folding along seventh side score line 95. Similarly, lid outside right panel 24*a* is erected substantially perpendicular lid front panel 20*a*, and substantially parallel to contiguous lid inside right panel 56, by folding along eighth side score line 96.

Outside left panel 22 is erected substantially perpendicular to lower front panel 20, and substantially parallel to contiguous inside left panel 53, by folding along first side score line 70. Similarly, outside right panel 24 is erected substantially perpendicular to lower front panel 20, and substantially parallel to contiguous inside right panel 54, by folding along second side score line 71.

Preferably, outside left panel 22 is adhesively attached to inside left panel 53, outside right panel 24 is adhesively attached to inside right panel 54, lid outside left panel 22*a* is adhesively attached to lid inside left panel 55, lid outside right panel 24*a* is adhesively attached to lid inside right panel 56, and lid connector panel 59 is adhesively attached to lid front panel 20*a*.

Innerframe 40 is preferably glued inside the lower portion 14 of pack 10, e.g., by gluing innerframe panels 44 and 46 to pack side walls 53 and 54, respectively.

Referring once again to FIG. 4, message tab 60 is folded against the inner sides of the front wall 20*a*, wall 30 and back wall 26*a* of the lid around the top portions of the cigarettes located within the box. When the lid 16 is opened, the message tab 60 will remain substantially in its face-to-face relationship with the interior of the lid as the bundle is opened and a cigarette removed. If the message tab unintentionally separates from the lid interior during opening, it is easily returned to the desired position upon closure of the lid. Alternatively, message tab 60 may intentionally separate, i.e., drop down from the lid interior as the package is opened. To accomplish this, pressure is applied to sides 22*a* and 24*a* as a means of lid opening and the interior panel drops to an incline position that makes viewing panel 60 most desirable.

To extend the tab 60 as shown in FIG. 5, the lid 16 is preferably opened completely such that top back wall 26*a* abuts an upper portion of back wall 26. The user then grasps the terminal end of tab 60, i.e., the proximal end relative to perforated detachment line 97, e.g., tab back panel 66, and straightens out message tab 60 such that tab front panel 62, tab top panel 64 and tab back panel 66 lie in substantially the same plane for reading by the user. The user may decide to detach the message tab at that time by tearing along detachment line 97 or may decide to fold tab 60 back into the lid for future reference and/or removal. Folding tab 60 back into the lid does not interfere with access to the cigarettes.

Tab 60 may comprise sections communicating various discrete messages to the consumer. For example, tab front panel 62, tab top panel 64 and tab rear panel 66 may each bear a distinct message. Fold line 61 and 63 may then conveniently be detached, e.g., via perforated or partially scored lining, to permit removal at the desired time. Each panel could be further subdivided as desired into two or more additional detachable message areas. By way of example, FIG. 3 depicts front tab panel 62 divided into respective first and second sections 62*a* and 62*b* via a detachment line 61*a*.

One or both sides of message tab 60 may be printed or embossed with any desired information. Preferably this information, and preferably the information more desired to be read if both sides are printed, is visible to the consumer when the message tab is opened as shown in FIG. 5. The information may include a suggestion that the consumer remove tab 60 from the pack. When that is done, additional information on tab 60, e.g., printed on the reverse side of tab 60, may become visible to the consumer. The removed tab may be a convenient size and shape for a coupon or coupon-like article.

Printing or embossing may be placed on tab 60 at any time, e.g., before or after pack blank 50 is cut to its final individual shape. A special eye mark may be included in printing applied prior to cutting to help register the cutting with the printing. If desired, the pack exterior can contain an appropriate notice regarding the presence of message tab 60 and/or its information.

Although FIG. 5 shows the pack with lid 16 partially open, it will be appreciated that the lid opens and closes exactly as described above. As in the prior art, when the lid of the pack shown in FIG. 1 is closed, the outer member of the pack completely encloses and obscures tab 60. Accordingly when the pack of FIG. 5 is closed as shown in FIG. 4, it functions and appears exactly as shown in FIG. 1.

Although tab 60 is shown in the drawings as a rectangle, it will be appreciated that it can have other shapes such as a scalloped edge, a rounded edge, or an arrowhead shaped edge. It also will be appreciated that tab 60 can have one or more holes or openings. Further, tab 60 can have one or more internal portions detachably attached to tab 60.

The dimensions of pack blank 50, and the dimensions of the panels and flaps comprising pack blank 50, are determined by the number, circumference and length of cigarettes to be packed in the erected pack 10.

The machine components used in the construction and erection of cigarette packs from paperboard blanks are well known in the art, and a discussion of the combination of machine components used to construct and erect packs of the present invention is not necessary to understand the present invention. Only a modification is required to the blank die to form the message tab section of the blank. The blank according to the present invention is folded with a dimension modification of 180° to the blank folding apparatus.

It will be understood that the foregoing is merely illustrative of the principles of this invention, and that various changes and modifications to the preferred embodiment can be made to provide other embodiments also contemplated by the invention and without departing from the scope and spirit of the invention. Accordingly, it is not intended that the invention be limited except by the appended claims. For example, lid 16 may be either integral with main portion 14 or glued to lower portion 14 by a flap. The lid of the pack may also slide on and off over the innerframe 40 rather than pivoting open and closed. Further, the principles of this invention can be applied to packs and pack components constructed of materials other than conventional paperboard. Further, it will be appreciated that the appended claims define cigarette packs in a conventional, upright orientation, as shown in FIGS. 1 and 5. Although cigarette packs of this invention can be inverted, turned on their side, or placed in any number of orientations, the appended claims define components of cigarette packs relative to other components when the cigarette packs are in a conventional, upright orientation. This convention is adopted for the sake of clarity and is not a limitation on the scope of the appended claims.

The present invention accordingly provides a mechanism for providing information to the consumer which is available for reading and/or removal at a desired time and which does not interfere with easy access to the product. No significant modification is required to existing machinery or tools. In addition, the present invention requires no change in the existing cigarette or pack dimensions.

Many modifications, substitutions and improvements will be apparent to the skilled artisan without departing from the spirit and scope of the present invention as described and defined in the foregoing and in the following claims.

I claim:

1. A cigarette pack for packaging cigarettes comprising:

a lower portion comprising a bottom wall, a front wall, a back wall, and two side walls which define a receptacle for containing cigarettes;

a hinged lid portion comprising a top wall, a front wall, a back wall, and two side walls, said hinged lid portion hingably connected at its back wall to said lower portion at the back wall of said lower portion, wherein said hinged lid portion is closable over the receptacle for containing cigarettes defined by said lower portion such that respective front and side walls of said hinged lid portion mate with respective front and side walls of said lower portion at respective mating edges; and a tab comprising a front tab panel and a top tab panel foldably connected to the front tab panel via a first tab fold line, said tab detachably attached at the front tab panel to the mating edge of the front wall of said hinged lid portion via a detachment line located opposite to the first tab fold line, wherein said tab is folded about the detachment line such that the front tab panel is in face- to-face contact with an inner side of the front wall of said hinged lid portion and wherein said tab is folded about the first tab fold line such that the top tab panel is in face-to-face contact with an inner side of the top wall of said hinged lid portion when said hinged lid portion is closed over the receptacle for containing cigarettes defined by said lower portion, wherein said tab is extendable from the mating edge of the front wall of said hinged lid portion and wherein said tab is detachable via the detachment line when said hinged lid portion is open.

2. The cigarette pack according to claim 1 wherein said tab further comprises a back tab panel foldably connected to the top tab panel via a second tab fold line located opposite the first tab fold line, wherein the tab is folded along the second tab fold line such that the tab back panel is in a face-to-face contact with an inner side of the back wall of said hinged lid portion when said hinged lid portion is closed.

3. The cigarette pack according to claim 2 wherein the tab is printed with predetermined indicia.

4. The cigarette pack according to claim 3 wherein the panels of said tab are subdivided into panel sections, wherein the panel sections are attached via detachment lines.

5. The cigarette pack according to claim 2, wherein the first tab fold line is a detachment line.

6. The cigarette pack according to claim 5 wherein the tab is printed with predetermined indicia.

7. The cigarette pack according to claim 6 wherein the panels of said tab are subdivided into panel sections, wherein the panel sections are attached via detachment lines.

8. The cigarette pack according to claim 2, wherein the second tab fold line is a detachment line.

9. The cigarette pack according to claim 8 wherein the tab is printed with predetermined indicia.

10. The cigarette pack according to claim 9 wherein the panels of said tab are subdivided into panel sections, wherein the panel sections are attached via detachment lines.

11. The cigarette pack according to claim 2, wherein the first tab fold line and the second tab fold line are detachment lines.

12. The cigarette pack according to claim 11 wherein the tab is printed with predetermined indicia.

13. The cigarette pack according to claim 12 wherein the panels of said tab are subdivided into panel sections, wherein the panel sections are attached via detachment lines.

14. The cigarette pack according to claim 1 wherein the tab is printed with predetermined indicia.

15. The cigarette pack according to claim 14 wherein the panels of said tab are subdivided into panel sections, wherein the panel sections are attached via detachment lines.

16. The cigarette pack according to claim 1 further comprising an innerframe member including a front wall disposed inside the front wall of said lower box, the front wall of said innerframe member having an upper edge which is below the mating edge of the front wall of said hinged lid box.

17. The cigarette pack according to claim 1, wherein the first tab fold line is a detachment line.

18. The cigarette pack according to claim 17 wherein the tab is printed with predetermined indicia.

19. The cigarette pack according to claim 18 wherein the panels of said tab are subdivided into panel sections, wherein the panel sections are attached via detachment lines.

* * * * *